US008530799B2

(12) United States Patent
Ding et al.

(10) Patent No.: US 8,530,799 B2
(45) Date of Patent: Sep. 10, 2013

(54) FLUID-HEATING APPARATUS AND METHODS OF OPERATING THE SAME

(75) Inventors: Wei Ding, Nanjing (CN); Bu Qiu, Nanjing (CN); Ping Ju, Nanjing (CN); Huaxin Wan, Nanjing (CN)

(73) Assignee: A.O. Smith (China) Water Heater Company, Ltd., Nanjing (CN)

( * ) Notice: Subject to any disclaimer, the term of this patent is extended or adjusted under 35 U.S.C. 154(b) by 1604 days.

(21) Appl. No.: 11/392,988

(22) Filed: Mar. 29, 2006

(65) Prior Publication Data

US 2007/0108187 A1 May 17, 2007

(30) Foreign Application Priority Data

Oct. 21, 2005 (CN) ..... 2005 1 0094932

(51) Int. Cl.
*F22B 1/28* (2006.01)

(52) U.S. Cl.
USPC ..... 219/492

(58) Field of Classification Search
USPC ..... 219/490, 492, 494, 497, 501, 507, 219/508, 509, 510; 392/463, 454, 441, 451
See application file for complete search history.

(56) References Cited

U.S. PATENT DOCUMENTS

| | | | | |
|---|---|---|---|---|
| 4,016,402 | A | 4/1977 | Scott | |
| 4,166,944 | A | 9/1979 | Scott | |
| 4,413,775 | A | 11/1983 | Scott | |
| 4,522,333 | A * | 6/1985 | Blau et al. | 236/20 R |
| 4,535,931 | A | 8/1985 | Bartok et al. | |
| 4,620,667 | A | 11/1986 | Vandermeyden et al. | |
| 4,832,259 | A | 5/1989 | Vandermeyden | |
| 4,834,284 | A | 5/1989 | Vandermeyden | |
| 5,626,287 | A | 5/1997 | Krause et al. | |
| 6,080,971 | A * | 6/2000 | Seitz et al. | 219/483 |
| 6,293,471 | B1 | 9/2001 | Stettin et al. | |
| 6,350,967 | B1 | 2/2002 | Scott | |
| 6,363,216 | B1 * | 3/2002 | Bradenbaugh | 392/463 |
| 6,627,858 | B2 | 9/2003 | Nomura et al. | |
| 6,795,644 | B2 | 9/2004 | Bradenbaugh | |
| 2004/0161227 | A1 * | 8/2004 | Baxter | 392/454 |
| 2006/0013572 | A1 * | 1/2006 | Phillips | 392/459 |

FOREIGN PATENT DOCUMENTS

| | | |
|---|---|---|
| CN | 00112584 | 3/2001 |

* cited by examiner

*Primary Examiner* — Brian Jennison

(74) *Attorney, Agent, or Firm* — Michael Best & Friedrich LLP

(57) ABSTRACT

Systems and methods of heating an accurate quantity of a fluid. A determination is made that an event in which a relatively large quantity of hot water is used has occurred. One or more temperatures are sensed. An increase in a temperature set point is made if the sensed temperatures indicate a shortage of hot water for the event. A decrease in the temperature set point is made if the sensed temperatures indicate an excess of hot water was available for the event. No change is made to the temperature set point if the quantity of hot water available for the event was appropriate.

25 Claims, 7 Drawing Sheets

FLUID-HEATING APPARATUS AND METHODS OF OPERATING THE SAME

RELATED APPLICATIONS

This application claims priority to Chinese Patent Application Serial No. 200510094932.8 filed Oct. 21, 2005, the entire contents of which are incorporated herein by reference.

BACKGROUND

The invention relates to fluid-heating apparatus, such as a storage-type water heater, and methods of operating the apparatus, such as to reduce energy consumption by the storage-type water heater while providing sufficient hot water to users.

Storage-type water heaters are commonly used to provide hot water to residential users. As the cost of energy has continued to rise, attempts have been made to reduce the amount of energy used by these water heaters. Insulation has been employed to reduce the radiant loss of heat from the storage tank, and therefore, reduce the need to reheat the water and to use additional energy. Controllers have been provided which monitor usage patterns and heat water only during periods when demand for hot water is expected or energy costs are low. These methods, while reducing energy usage, can still use energy beyond what is necessary to provide adequate hot water to the user.

SUMMARY

In one embodiment, the invention provides a fluid-heating apparatus, for heating a fluid. The fluid-heating apparatus includes a vessel, an inlet to introduce fluid into the vessel, an outlet to remove fluid from the vessel, a heating device, a temperature sensor, and a control circuit. The control circuit is configured to monitor the temperature sensor and activate the heating device when a temperature sensed is less than a set point. The control circuit is further configured to determine that a high-quantity usage event has occurred and to adjust the set point following the end of the high-quantity usage event based on a sensed temperature.

In another embodiment, the invention provides a method of heating a fluid in a fluid-heating apparatus by sensing a temperature having a relation to the fluid, determining a high-quantity usage event has occurred, increasing a temperature set point if the sensed temperature is less than a low-temperature threshold, or decreasing a temperature set point if the sensed temperature is greater than a high-temperature threshold. A high-quantity usage event is determined to have occurred if a rate of change of the sensed temperature exceeds a first-rate threshold. The high-quantity usage event is determined to have ended if the rate of change of the sensed temperature is less than a second-rate threshold following the rate of change of the sensed temperature exceeding the first-rate threshold.

In another embodiment, the invention provides a method of determining a high-quantity usage event in a fluid-heating apparatus by sensing a temperature in the fluid-heating device, calculating a rate of change of the sensed temperature, comparing the rate of change of the sensed temperature to a first threshold, and determining the high-quantity usage event when the rate of change of the sensed temperature traverses the first threshold.

In another embodiment, the invention provides a method of determining completion of a high-quantity usage event in a fluid-heating apparatus by determining a high-quantity usage event has occurred, sensing a temperature in the fluid-heating device, calculating a rate of change of the sensed temperature, comparing the rate of change of the sensed temperature to a threshold, and determining the high-quantity usage event has completed when the rate of change of the sensed temperature is less than the threshold.

In another embodiment, the invention provides a method of heating a fluid in a fluid-heating apparatus including a temperature sensor for monitoring a temperature of the fluid. The method includes sensing a first temperature with the temperature sensor, controlling a heating device using the first temperature, determining an occurrence of a high-quantity usage event, determining the high-quantity usage event has ended, sensing a second temperature with the temperature sensor following the end of the high-quantity usage event, and increasing the temperature set point if the second temperature is less than a low-temperature threshold or, reducing the temperature set point if the second temperature is greater than a high-temperature threshold.

In another embodiment, the invention provides a method of heating a fluid in a fluid-heating apparatus including a first temperature sensor located in an upper portion of the fluid-heating apparatus and a second temperature sensor located in a lower portion of the fluid-heating apparatus. The method includes sensing a first temperature with the first temperature sensor and activating a heating device if the first temperature is less than a temperature set point. Once a high-quantity usage event has ended, the method senses a second temperature with the second temperature sensor, and increases the temperature set point if the second temperature is less than a low-temperature threshold or reduces the temperature set point if the second temperature is greater than a high-temperature threshold. The method further includes determining a rate of change of the first temperature, and reducing the temperature set point by a factor if the second temperature is between the low-temperature threshold and the high-temperature threshold.

In another embodiment, the invention provides a method of heating a fluid in a fluid-heating apparatus including a plurality of temperature sensors located at different heights in the fluid-heating apparatus. The method includes sensing a temperature at each of the plurality of temperature sensors, detecting a high-quantity usage event, and determining an end of the high-quantity usage event has occurred. The method further includes raising a temperature set point based on a temperature sensed at the temperature sensor located at the highest position in the fluid-heating apparatus and the temperature sensor at the lowest position in the fluid-heating apparatus if the high-quantity usage event was detected by the temperature sensor in the highest position in the fluid-heating apparatus. The method also includes lowering the temperature set point based on the highest temperature sensor in the fluid-heating apparatus to detect the high-quantity usage event if the high-quantity usage event was not detected by the temperature sensor in the highest position in the fluid-heating apparatus.

In another embodiment, the invention provides a method of heating a fluid in a fluid-heating apparatus by repeatedly sensing a temperature in the fluid-heating apparatus, determining an end of a high-quantity usage event using the sensed temperature, and setting a temperature set point based on a relation to the sensed temperature.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The invention relates to automatically setting a temperature set point in a fluid-heating apparatus, such as a storage-type water heater. The temperature set point is set such that a sufficient quantity of hot water is available for a user but little or no excess hot water remains after an event in which a relatively large quantity of hot water is used. The lack of excess hot water following this usage indicates that energy was not wasted in heating water beyond what was necessary.

Figure 1:
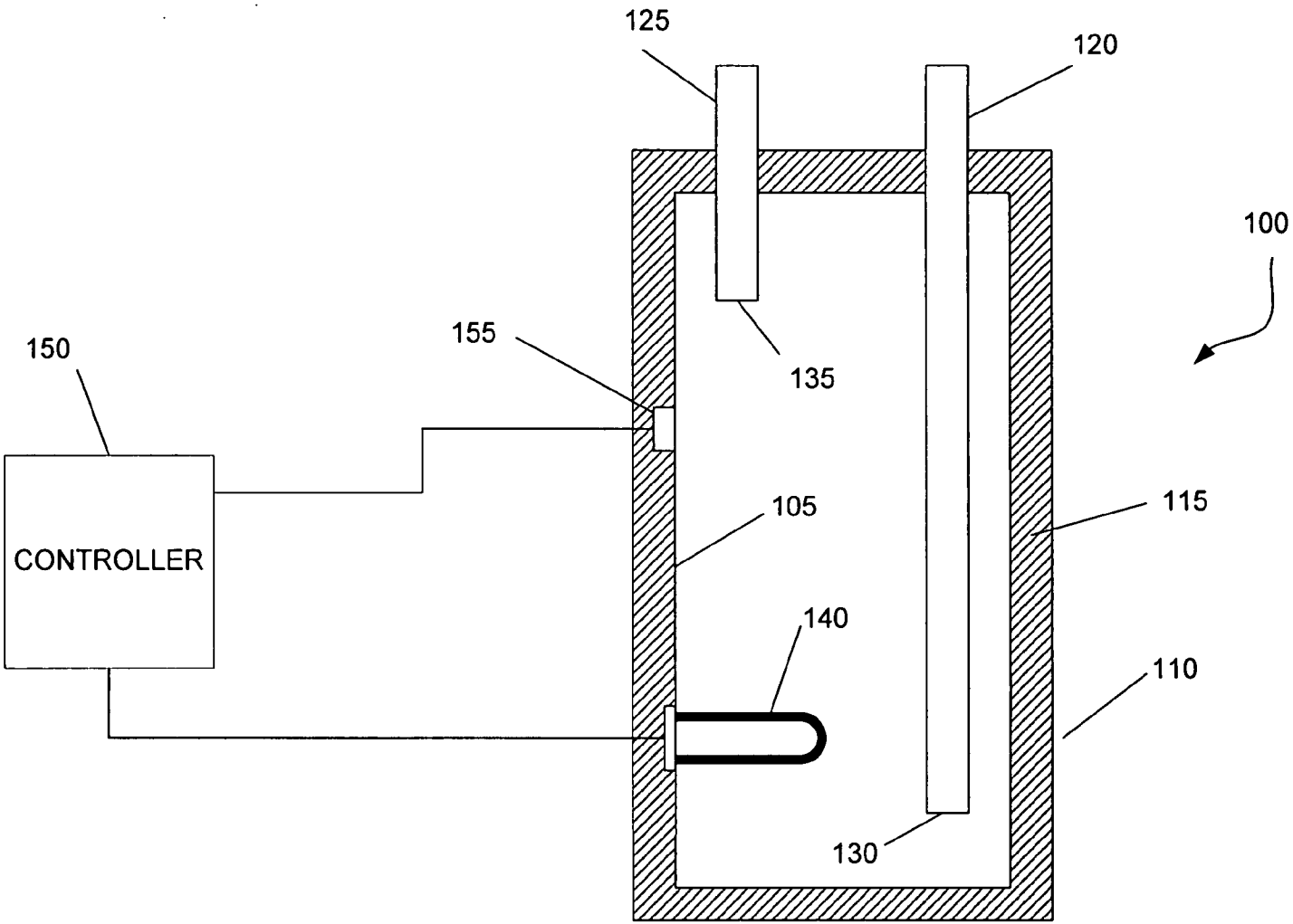
FIG. 1 is a partial block diagram, partial sectional view of a first construction of a water heater embodying the invention.

FIG. 1 illustrates a first construction of a storage-type water heater 100 according to the invention. The water heater 100 includes an enclosed water tank 105 (also referred to herein as an enclosed vessel), a shell 110 surrounding the water tank 105, and foam insulation 115 filling the annular space between the water tank 105 and the shell 110. A typical storage tank 105 is made of ferrous metal and lined internally with a glass-like porcelain enamel to protect the metal from corrosion. However, the storage tank 105 can be made of other materials, such as plastic. A water inlet line or dip tube 120 and a water outlet line 125 enter the top of the water tank 105. The water inlet line 120 has an inlet opening 130 for adding cold water to the water tank 105, and the water outlet line 125 has an outlet opening 135 for withdrawing hot water from the water tank 105. The tank may also include a grounding element (or contact) that is in contact with the water stored in the tank.

The water heater 100 also includes an electric-resistance heating element 140 that is attached to the tank 105 and extends into the tank 105 to heat the water. While a storage-type water heater 100 having the electric-resistance heating element 140 is shown, the invention can be used with other fluid-heating devices (such as other types of water heaters, oil or gas heaters, etc.), or other heating elements (such as a gas-heating element or gas burner, a combination electric-resistance heating element and gas burner, etc.), element designs, and arrangements.

FIG. 1 also shows a controller 150 coupled to the heating element 140 and a temperature sensor 155. The temperature sensor is positioned between an outside wall of the tank 105 and the insulation 115 in an upper portion of the tank 105. The temperature sensor 155 detects a temperature indicative of the temperature of the water inside the tank 105. In some constructions, the temperature sensor 155 can be positioned inside the tank 105, or coupled to or in the inlet 120 or the outlet 125.

Hot water is drawn from the water heater 100 through the outlet opening 135 and is replaced by relatively colder water entering the water heater 100 through the inlet opening 130. The entering cold water mixes with the hot water in the tank 105. Over time or once a large enough volume of hot water has been replaced with the relatively cold water, the temperature of the water surrounding the temperature sensor 155 drops. Once the water surrounding the temperature sensor 155 reaches a threshold, the controller 150 activates the heating element 140 to heat the water in the tank 105. The controller 150 can include an integrated circuit, discrete circuit elements, a micro device (e.g., a microcontroller, a microprocessor and memory, etc.) and similar components to control the water heater 100. The controller 150 furthers include a switching element, such as a relay, thyristor, or triac, to selectively control the power applied to the heating element 140.

In one specific construction, the controller 150 includes a microcontroller that receives signals or inputs from a plurality of sensors, analyzes the inputs, and generates outputs to control the heating element 140. In addition, the microcontroller can receive other inputs (e.g., inputs from a user, an ambient temperature sensor, etc.) and can generate outputs to control other elements of the water heater. The microcontroller can include a processor and memory. The memory includes one or more modules having instructions. The processor obtains, interprets, and executes the instructions to control the water heater 100, including the heating element 140.

The temperature of the water in the water heater 100 is generally maintained at a level in excess of the temperature a user desires. The user therefore mixes a quantity of cold water with the hot water to achieve the desired temperature. The hotter the water in the water heater 100 (and the warmer the cold water) the greater the quantity of cold water and the lesser the quantity of hot water the user will use in the mix. Therefore, the temperature of the hot water impacts the quantity of hot water used relative to a quantity of total water used. In discussing a quantity of hot water from the hot water heater 100, the quantity of hot water is greater, for the same amount of water, for a higher temperature of water in the hot water heater 100 than for a lower temperature of water in the hot water heater 100.

A typical water heater provides water for numerous functions. These functions require quantities of hot water that are significantly different from one another. Table 1 summarizes some typical functions and an estimated quantity of hot water required for each.

Referring to table 1, hot water usage can be divided into large quantity use (e.g., bathing) and low quantity use (e.g., shaving). Adjusting a temperature set point of a water heater to provide just enough hot water for a low quantity use results in not enough hot water being available for high quantity uses. Therefore, it is a goal of the invention to provide adequate quantities of hot water for high quantity uses while minimizing the quantity of remaining hot water following a high quantity use.

TABLE 1

| Hot Water Requirements | |
|---|---|
| Hot Water Use | Average Gallons Per Use |
| Showering | 15 |
| Bathing | 20 |
| Shaving | 2 |
| Washing hands and face | 2 |
| Shampooing hair | 4 |
| Hand dishwashing | 2 |
| Automatic dishwashing | 14 |
| Food preparation | 5 |
| Clothes washing | 32 |

It is necessary to determine when a high quantity of hot water has been used (also referred to herein as a high-quantity usage event) such that adjustments to the temperature set point can be made only following a high quantity of hot water usage and not following a low quantity of hot water usage. In an embodiment of the invention, a high quantity of hot water is determined to have been used when the temperature sensed at the temperature sensor 155 has fallen at least a predetermined amount (e.g., 2° F. or 1° C.) each time period (e.g., one minute) for a predetermined number of time periods (e.g., three). Alternatively, other methods for determining a high-quantity usage event can be used. For example, a high-quantity usage event can be determined by a flow meter in the path of the water flow measuring an actual quantity of water used.

Figure 2:
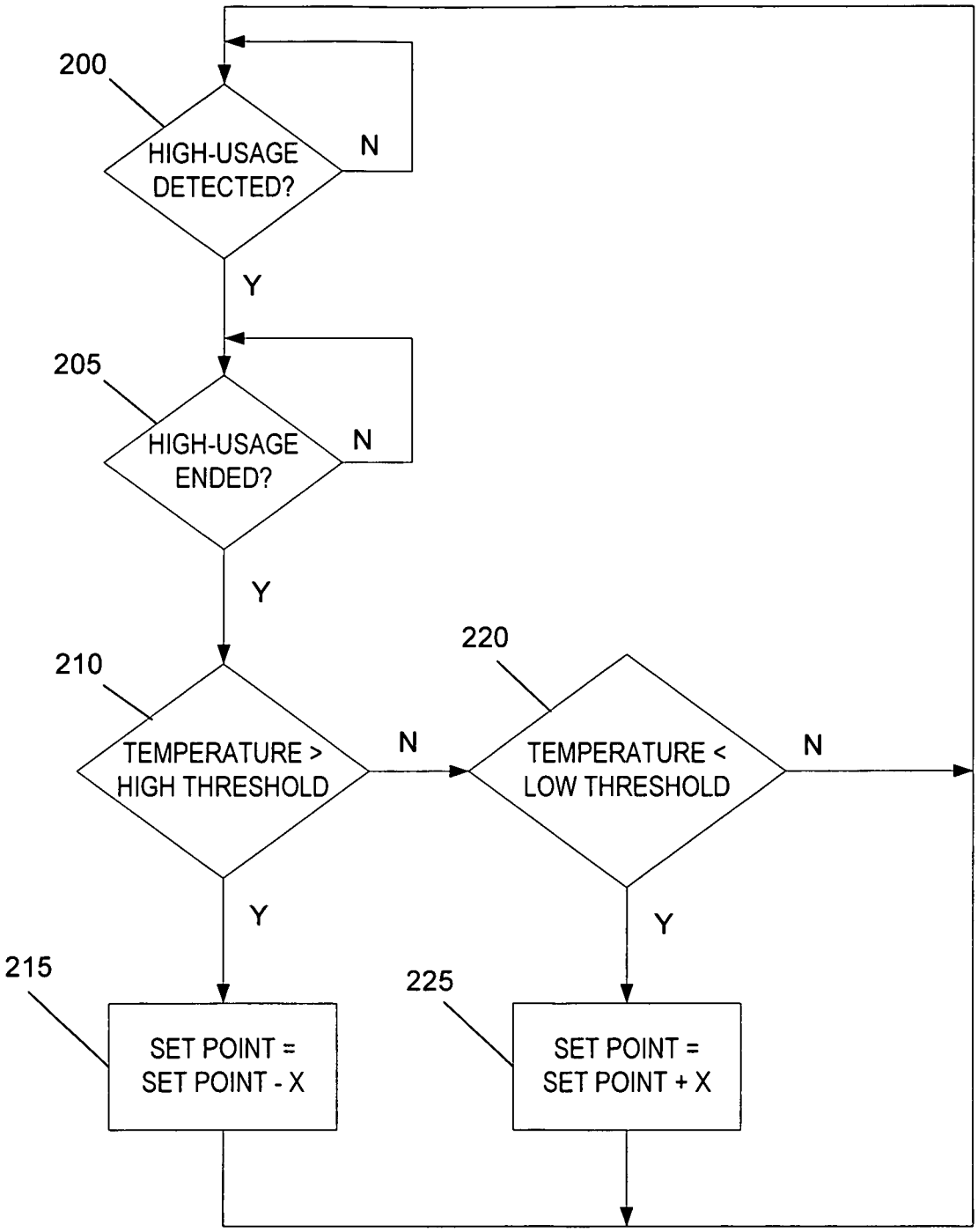
FIG. 2 is a flowchart of the operation of the controller of FIG. 1 for adjusting a temperature set point to heat an accurate quantity of water.

FIG. 2 is an embodiment of a process for automatically adjusting a temperature set point of the water heater 100 in the construction shown in FIG. 1. The controller 150 monitors the temperature sensor 155 to determine if a high-quantity usage event is in progress (block 200). If the sensed temperature has not dropped sufficiently over the predetermined time periods, a high-quantity usage event has not occurred and the controller 150 continues to monitor the temperature sensor 155 (block 200).

If the controller determines that a high-quantity usage event is in progress, the controller 150 waits until the high-quantity usage event has ended (block 205). The controller 150 determines, in one construction, that a high-quantity usage event has ended when the sensed temperature remains constant for, or rises for, a number (e.g., 2) of time periods (e.g., one minute). If the high-quantity usage event has not ended, the controller 150 continues to monitor the temperature sensor 155 until the high-quantity usage event does end.

Before proceeding further, it should be understood that the figures, including FIG. 2, show select methods of operating the water heater. However, other methods are possible. For example, the order of steps disclosed in the figures may vary. Furthermore, additional steps can be added to the sequence and not all of the steps may be required. It should also be noted; other processes can run continuously in parallel with the processes described herein. In one parallel process, for example, the controller 150 monitors the temperature sensor 155 and if the sensed temperature is below a temperature set point, the controller activates the heating element 140 to heat the water in the tank 105. When the sensed temperature is above the temperature set point, the water is at a desired temperature and, the controller 150 deactivates the heating element 140. In some embodiments, a dead band control scheme activates the heating element 140 at a temperature less than the temperature set point and deactivates the heating element 140 at a temperature above the temperature set point.

Referring again to the process of FIG. 2, following the end of the high-quantity usage event, the controller compares (block 210) the temperature received from the temperature sensor 155 to a high-temperature threshold (e.g., 115° F. or 45° C.). If the sensed temperature is above the high-temperature threshold, the controller determines that excess hot water remains in the water heater 100. The determination, that excess hot water remains in the water heater 100, indicates that the water was heated to a higher temperature than was necessary to provide hot water for the high-quantity usage event just ended. Therefore, the controller reduces (block 215) the temperature set point by a preset amount (e.g., 10° F. or 5° C.) in an attempt to anticipate the quantity of hot water necessary for the next high-quantity usage event. The controller 150 then waits for the next high-quantity usage event (block 200).

If, at block 210, the sensed temperature was not greater than the high-temperature threshold, the controller 150 compares (block 220) the sensed temperature to a low-temperature threshold (e.g., 90° F. or 30° C.). If the sensed temperature is above the low-temperature threshold, the controller 150 determines that the correct amount of hot water was available for the high-quantity usage event. The controller 150, therefore, leaves the temperature set point unchanged as the controller 150 had correctly anticipated the quantity of hot water necessary for the just ended high-quantity usage event. The controller 150 then continues by waiting for the next high-quantity usage event (block 200).

If, at block 220, the sensed temperature is below the low-temperature threshold, the controller 150 determines that there was not enough hot water available for the high-quantity usage event and, therefore, the temperature set point was too low. The controller 150 then increases (block 225) the set point by a predetermined amount (e.g., 10° F. or 5° C.) in an attempt to anticipate the quantity of hot water necessary for the next high-quantity usage event. The controller 150 then waits for the next high-quantity usage event (block 200).

Figure 3:
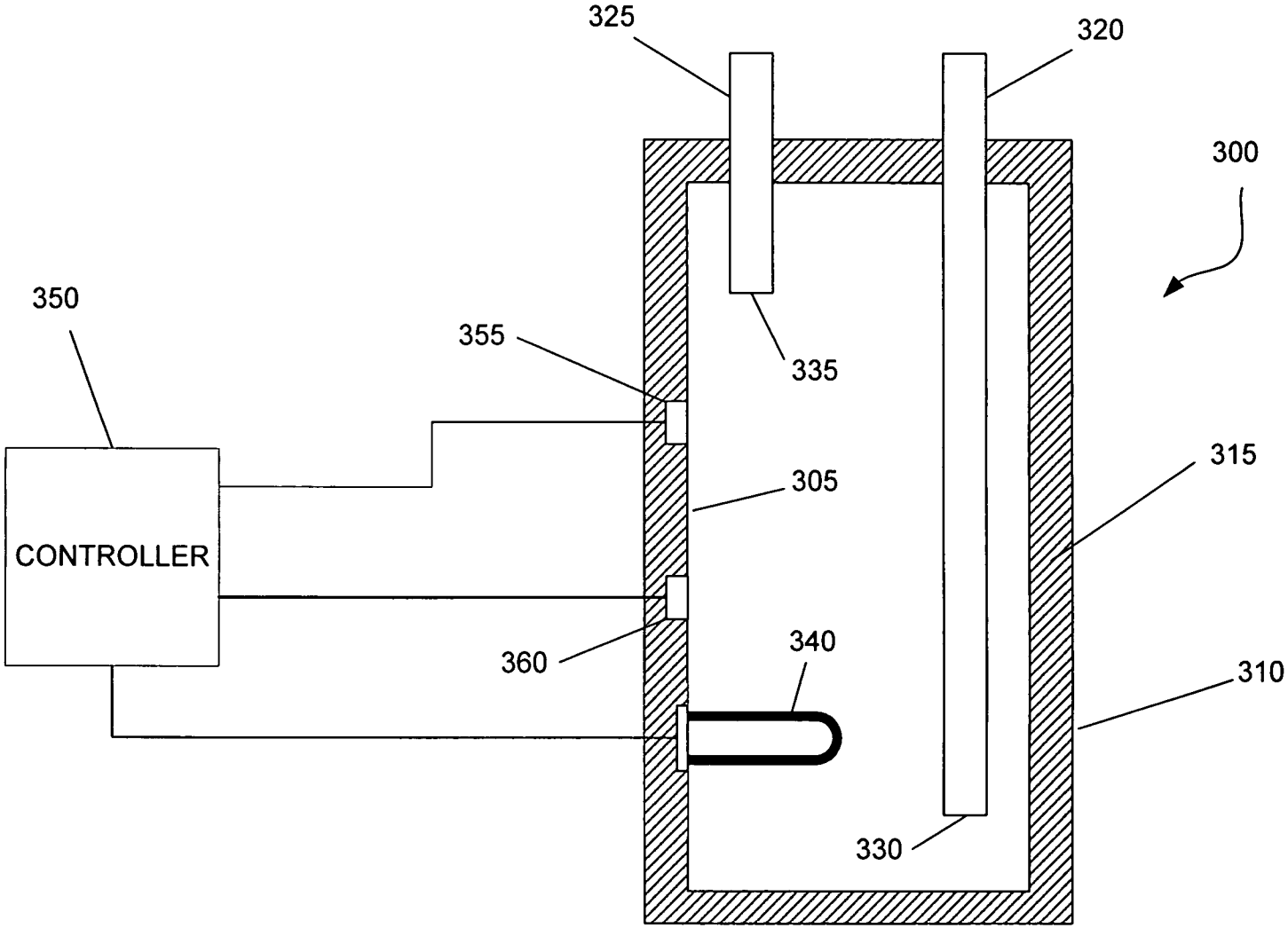
FIG. 3 is a partial block diagram, partial sectional view of a second construction of a water heater embodying the invention.

FIG. 3 shows a second construction of a water heater 300 of the invention including a first temperature sensor 355 and a second temperature sensor 360. The first temperature sensor 355 is positioned on the outside of the tank 305 at a point higher than the second temperature sensor 360 which is also positioned on the outside of the tank 305. A controller 350 receives the sensed temperature readings from the first and second temperature sensors 355 and 360 and controls a heating element 340.

In some constructions, the controller 350 activates and deactivates the heating element 340 based on a temperature set point and at least one of a temperature sensed by the first temperature sensor 355, a temperature sensed by the second temperature sensor 360, and an average of a temperature sensed by the first temperature sensor 355 and a temperature sensed by the second temperature sensor 360.

Figure 4:
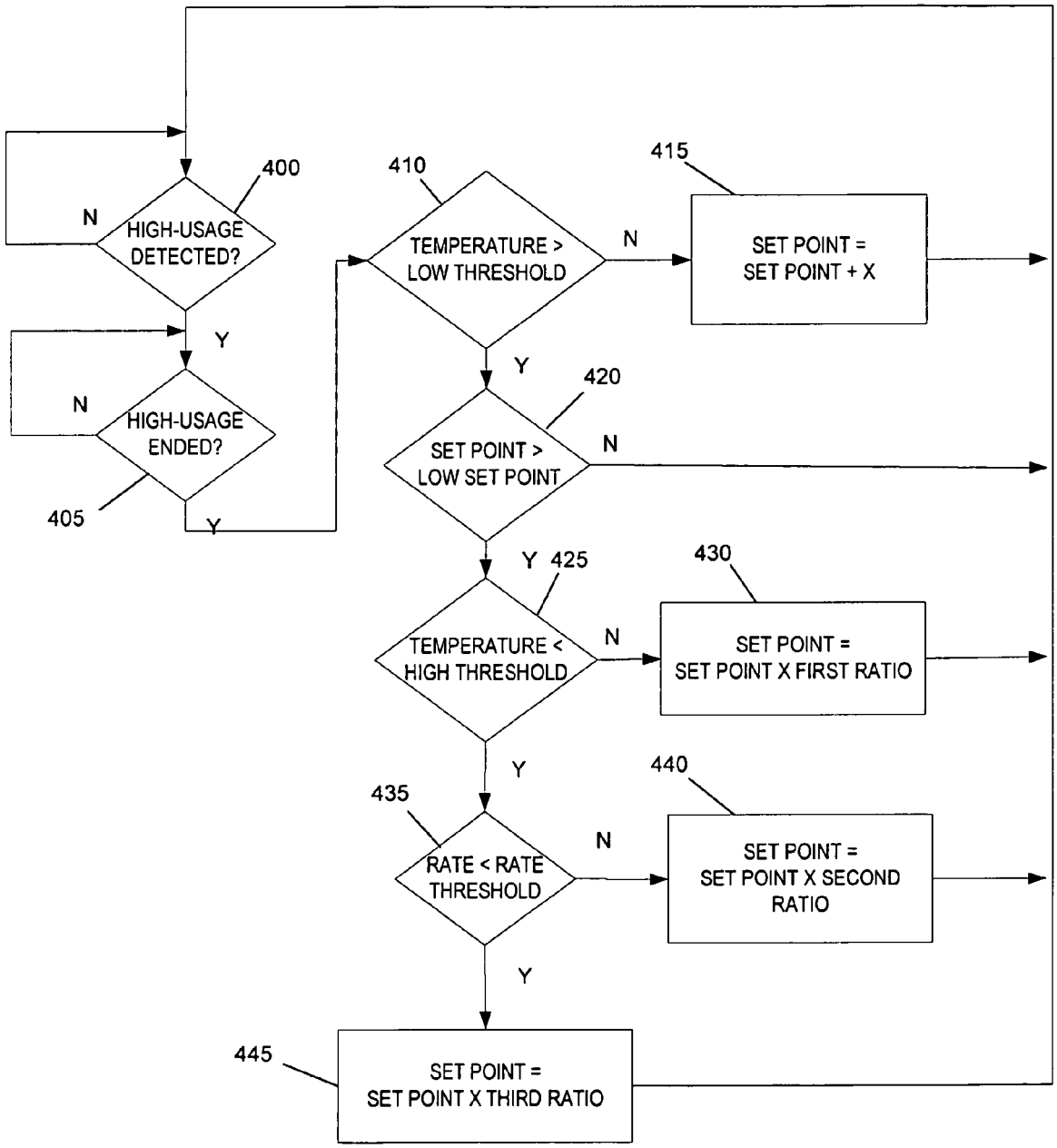
FIG. 4 is a flowchart of the operation of the controller of FIG. 3 for adjusting a temperature set point to heat an accurate quantity of water.

FIG. 4 shows an embodiment of a process for automatically adjusting a temperature set point of a water heater for the construction shown in FIG. 3. The controller 350 determines if a high-quantity usage event has occurred (block 400) by monitoring the second temperature sensor 360 in the same manner as described above for block 200 of FIG. 2. The controller 350 also determines when a high-quantity usage event has ended (block 405) by monitoring the second temperature sensor 360 in the same manner as described above for block 205 of FIG. 2.

Following the end of a high-quantity usage event, the controller 350 compares (block 410) the temperature detected by the first temperature sensor 355 to a low-temperature threshold (e.g., 90° F. or 30° C.). If the temperature sensed by the first temperature sensor is equal or below the low-temperature threshold, the water heater 300 did not have enough hot water for the high-quantity usage event. The controller 350, therefore, increases the temperature set point (block 415) by a predetermined amount (e.g., 10° F. or 5° C.) in an attempt to ensure enough hot water is available for the next high-quantity usage event. The controller 350 then waits for the next high-quantity usage event (block 400).

If the temperature sensed by the first temperature sensor 355 was above the low-temperature threshold, the controller 350 checks (block 420) the temperature set point to determine if the temperature set point is equal or below a low set point threshold (e.g., 115° F. or 45° C.). If the temperature set point is equal or below the set point threshold, the controller 350 determines that the temperature set point should not be lowered any further and continues with waiting for the next high-quantity usage event (block 400).

If, at block 420, the temperature set point was above the low set point threshold, the controller 350 compares (block 425) the temperature sensed by the second temperature sensor 360 to a high-temperature threshold (e.g., 115° F. or 45° C.). If the sensed temperature is not below the high-temperature threshold an excess of hot water remained in the water heater following the high-quantity usage event. The controller 350, therefore, reduces (block 430) the temperature set point by multiplying the temperature set point by a first ratio or percentage (e.g., 75%) in an attempt to anticipate the quantity of hot water necessary for the next high-quantity usage event. The controller 350 then continues processing at block 400 waiting for the next high-quantity usage event.

If the sensed temperature, at block 425, is less than the high-temperature threshold, the controller 350 compares (block 435) a rate at which the sensed temperature of the water was dropping at the first temperature sensor. The rate the temperature was dropping is determined by dividing a drop in temperature detected by the first temperature sensor 355 over a period of time (e.g., two minutes) by the time. If the rate at which the temperature sensed by the first temperature sensor 355 was dropping is equal to or greater than a rate threshold (e.g., 0.6° F./minute or 0.3° C./minute), the controller 350 reduces (block 440) the temperature set point by multiplying the temperature set point by a second ratio or percentage (e.g., 83.3%) and continues processing at block 400 waiting for the next high-quantity usage event. If the rate at which the temperature sensed by the first temperature sensor 355 was dropping is less than the rate threshold, the controller 350 reduces (block 445) the temperature set point by multiplying the temperature set point by a third ratio or percentage (e.g., 91.7%) and continues processing at block 400 waiting for the next high-quantity usage event.

Figure 5:
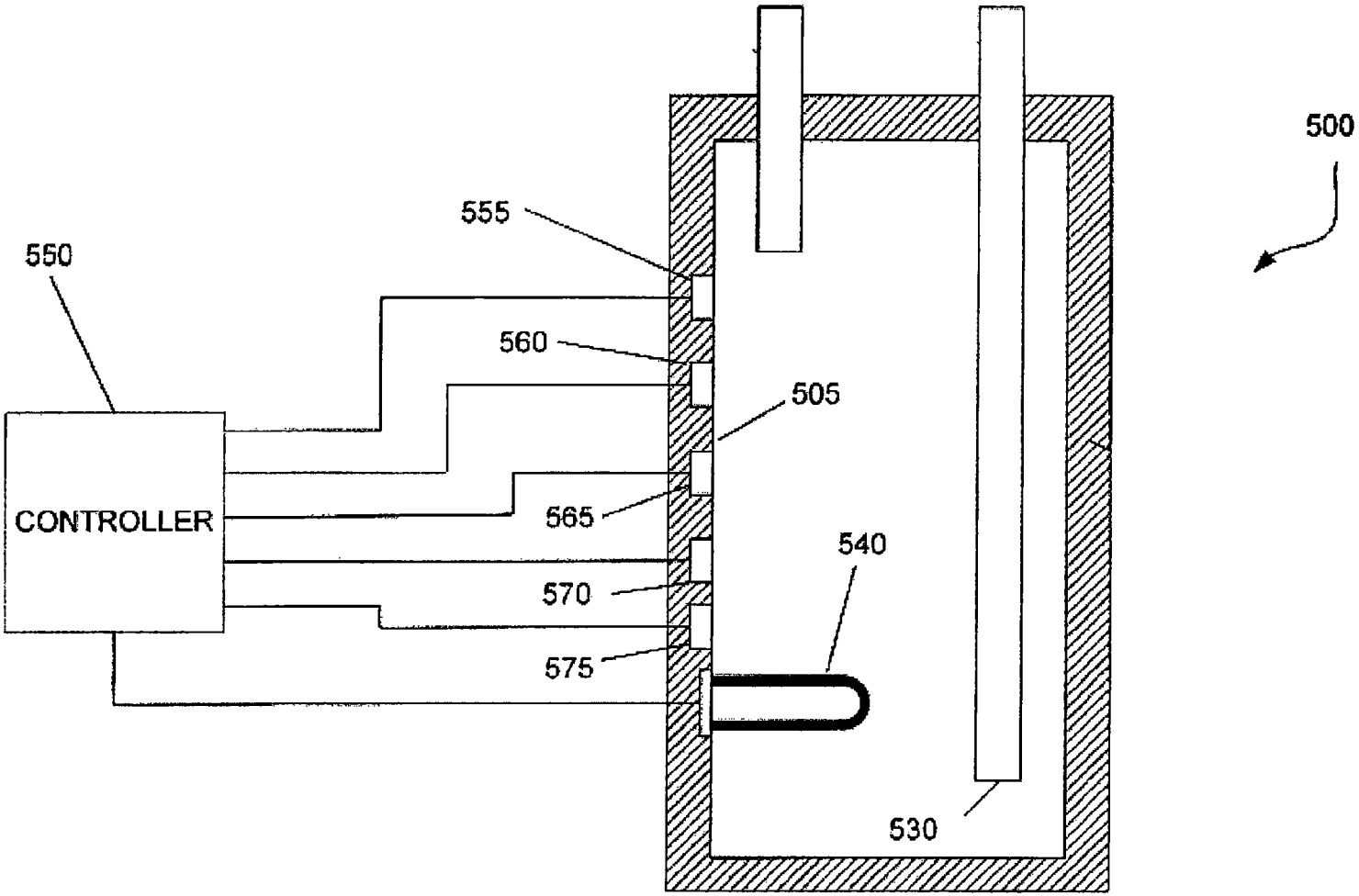
FIG. 5 is a partial block diagram, partial sectional view of a third construction of a water heater embodying the invention.

FIG. 5 shows another construction of the invention including a first temperature sensor 555, a second temperature sensor 560, a third temperature sensor 565, a fourth temperature sensor 570, and a fifth temperature sensor 575. The first temperature sensor 555 is positioned near the top of a tank 505. The second temperature sensor 560, third temperature sensor 565, fourth temperature sensor 570, and fifth temperature sensor 575 are positioned at successively lower positions on the tank 505. The temperature sensors 555 to 575 provide signals to a controller 550 that are indicative of the temperature of the water near the respective sensors 555 to 575. The controller 550 activates a heating element 540 when a temperature detected by one or more of the temperature sensors 555 to 575 is below a temperature set point.

In the construction shown, the controller 550 determines if a high-quantity usage event has occurred as described in the previous constructions and embodiments. Following the end of the high-quantity usage event, the controller 550 determines the highest positioned temperature sensor to detect the high-quantity usage event. Since relatively cold water enters the water heater 500 through an inlet 530 which is located in the lower portion of the tank 505, the fifth temperature sensor 575 may be the first sensor to detect a high-quantity usage event. As how water continues to be removed from the water heater 500, the second temperature sensor may detect the high-quantity usage event next. This process continues until the high-quantity usage event ends or all of the temperature sensors have detected the event. The controller 550 can estimate the quantity of hot water remaining in the water heater 500, after the high-quantity usage event, based on the highest temperature sensor to detect the event. The controller 550 can then adjust the temperature set point to provide an accurate quantity of hot water for the next high-quantity usage event.

Figure 6A:
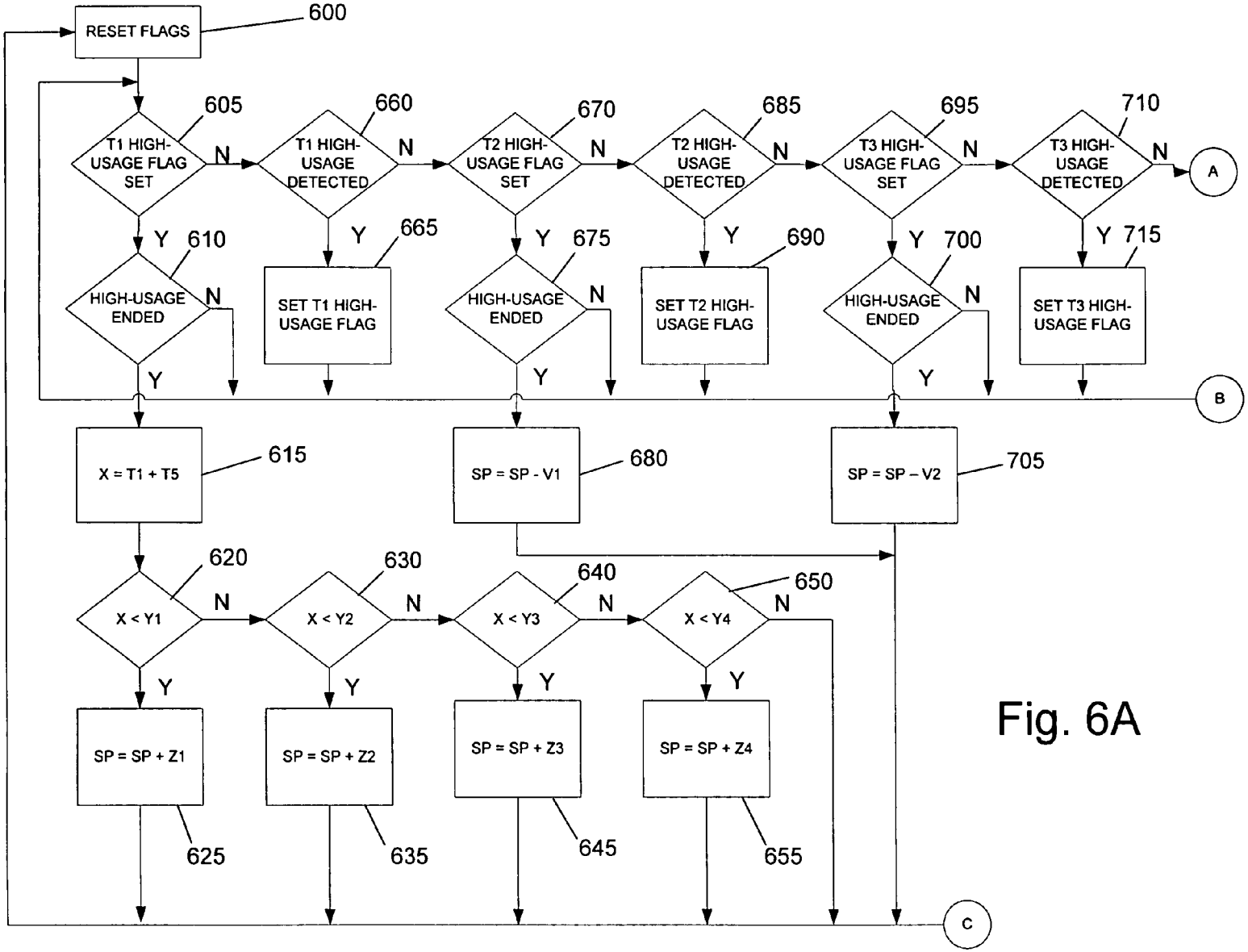
FIGS. 6A and 6B are flowcharts of the operation of the controller of FIG. 5 for adjusting a temperature set point to heat an accurate quantity of water.
Figure 6B:
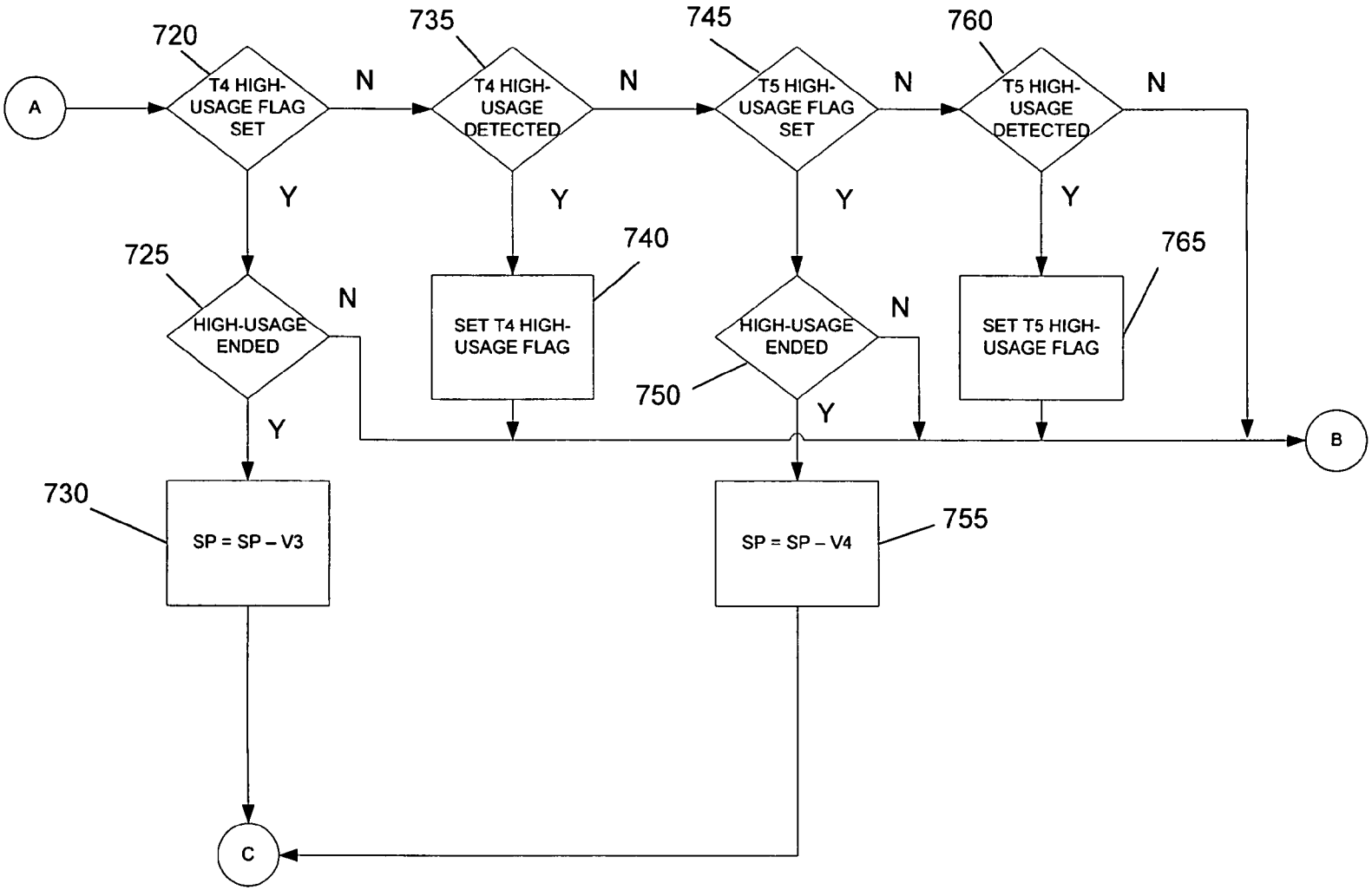

FIGS. 6A and 6B are flow charts of an embodiment of the operation of the construction shown in FIG. 5 for providing a correct quantity of hot water to a high-quantity usage event. The controller 550 begins operation by resetting a plurality of flags in the system (block 600). Next the controller 550 checks if a first temperature sensor event detection flag has been set (block 605) If the first temperature sensor event detection flag has been set, the first temperature sensor 555 has previously detected a high-quantity usage event and the controller 550 checks if the high-quantity usage event has ended (block 610).

Determination of the end of a high-quantity usage event, in the construction shown, can be accomplished as shown in previous embodiments using one or more temperature sensors alone or in combination with one another. The determination of the end of a high quantity usage event can be made using the same or different rates for each sensor. In some embodiments, the end of a high-quantity usage event is determined, as discussed previously, using the highest temperature sensor to detect the high-quantity usage event.

If, at block 610, the controller 550 determines that the high-quantity usage event has ended, the controller 550 adds the temperature sensed by the first temperature sensor 555 to the temperature sensed by the fifth temperature sensor 575 (block 615) producing a sum of the temperatures. The controller 550 then compares (block 620) the sum of the temperatures to a first summed threshold (e.g., 130° F. or 55° C.). If the sum of the temperatures is less than the first summed threshold, the quantity of hot water was substantially less than required for the high-quantity usage event. The controller then increases (block 625) the temperature set point by a first incremental amount (e.g., 40° F. or 20° C.) in an attempt to anticipate the quantity of hot water necessary for the next high-quantity usage event. The controller 550 then resets the flags (block 600) and waits for the next high-quantity usage event.

If, at block 620, the sum of the temperatures was not less than the first summed threshold, the controller 550 compares (block 630) the sum of the temperatures to a second summed threshold (e.g., 135° F. or 58° C.). If the sum of the temperatures is less than the second summed threshold, the quantity of hot water was substantially less (but was closer to the accurate quantity than at block 625) than required for the high-quantity usage event. The controller then increases (block 635) the temperature set point by a second incremental amount (e.g., 30° F. or 15° C.) in an attempt to anticipate the quantity of hot water necessary for the next high-quantity usage event. The controller 550 then resets the flags (block 600) and waits for the next high-quantity usage event.

If, at block 630, the sum of the temperatures was not less than the second summed threshold, the controller 550 compares (block 640) the sum of the temperatures to a third summed threshold (e.g., 140° F. or 61° C.). If the sum of the temperatures is less than the third summed threshold, the quantity of hot water was substantially less (but, again, was closer to the accurate quantity than at block 635) than required for the high-quantity usage event. The controller then increases (block 645) the temperature set point by a third incremental amount (e.g., 20° F. or 10° C.) in an attempt to anticipate the quantity of hot water necessary for the next high-quantity usage event. The controller 550 then resets the flags (block 600) and waits for the next high-quantity usage event.

If, at block 640, the sum of the temperatures was not less than the third summed threshold, the controller 550 compares (block 650) the sum of the temperatures to a fourth summed threshold (e.g., 145° F. or 63° C.). If the sum of the temperatures is less than the fourth summed threshold, the quantity of hot water was less than required for the high-quantity usage event. The controller then increases (block 655) the temperature set point by a fourth incremental amount (e.g., 10° F. or 5° C.) in an attempt to anticipate the quantity of hot water necessary for the next high-quantity usage event. The controller 550 then resets the flags (block 600) and waits for the next high-quantity usage event.

If, at block 650, the sum of the temperatures was not less than the fourth summed threshold, the controller 550 determines that an appropriate quantity of hot water was available for the high-quantity usage event and the controller does not adjust the temperature set point. The controller 550 then resets the flags (block 600) and waits for the next high-quantity usage event.

If, at block 605, the first temperature sensor event detection flag is not set, the controller 550 determines if the first temperature sensor 555 has detected a high-quantity usage event (block 660). If the first temperature sensor 555 has detected a high-quantity usage event, the controller 550 sets the first temperature sensor event detection flag (block 665) and continues processing at block 605.

If, at block 660, the first temperature sensor 555 has not detected a high-quantity usage event, the controller 550 determines if a second temperature sensor event detection flag is set (block 670). If the second temperature sensor event detection flag is set, the second temperature sensor 560 has previously detected a high-quantity usage event and the controller 550 checks if the high-quantity usage event has ended (block 675). If the high-quantity usage event has ended, the controller 550 decreases (block 680) the temperature set point by a first decremental amount (e.g., 10° F. or 5° C.) in an attempt to anticipate the quantity of hot water necessary for the next high-quantity usage event. The controller 550 then continues with resetting the flags at block 600.

If, at block 670, the second temperature sensor event detection flag is not set, the controller 550 determines if the second temperature sensor 560 has detected a high-quantity usage event (block 685). If the second temperature sensor 560 has detected a high-quantity usage event, the controller 550 sets the second temperature sensor event detection flag (block 690) and continues processing at block 605.

If, at block 685, the second temperature sensor 560 has not detected a high-quantity usage event, the controller 550 determines if a third temperature sensor event detection flag is set (block 695). If the third temperature sensor event detection flag is set, the third temperature sensor 565 has previously detected a high-quantity usage event and the controller 550 checks if the high-quantity usage event has ended (block 700). If the high-quantity usage event has ended, the controller 550 decreases (block 705) the temperature set point by a second decremental amount (e.g., 20° F. or 10° C.) in an attempt to anticipate the quantity of hot water necessary for the next high-quantity usage event. The controller 550 then continues with resetting the flags at block 600.

If, at block 695, the third temperature sensor event detection flag is not set, the controller 550 determines if the third temperature sensor 565 has detected a high-quantity usage event (block 710). If the third temperature sensor 565 has detected a high-quantity usage event, the controller 550 sets the third temperature sensor event detection flag (block 715) and continues processing at block 605.

If, at block 710, the third temperature sensor 565 has not detected a high-quantity usage event, the controller 550 determines if a fourth temperature sensor event detection flag is set (block 720). If the fourth temperature sensor event detection flag is set, the fourth temperature sensor 570 has previously detected a high-quantity usage event and the controller 550 checks if the high-quantity usage event has ended (block 725). If the high-quantity usage event has ended, the controller 550 decreases (block 730) the temperature set point by a third decremental amount (e.g., 30° F. or 15° C.) in an attempt to anticipate the quantity of hot water necessary for the next high-quantity usage event. The controller 550 then continues with resetting the flags at block 600.

If, at block 720, the fourth temperature sensor event detection flag is not set, the controller 550 determines if the fourth temperature sensor 570 has detected a high-quantity usage event (block 735). If the fourth temperature sensor 570 has detected a high-quantity usage event, the controller 550 sets the fourth temperature sensor event detection flag (block 740) and continues processing at block 605.

If, at block 735, the fourth temperature sensor 570 has not detected a high-quantity usage event, the controller 550 determines if a fifth temperature sensor event detection flag is set (block 745). If the fifth temperature sensor event detection flag is set, the fifth temperature sensor 575 has previously detected a high-quantity usage event and the controller 550 checks if the high-quantity usage event has ended (block 750). If the high-quantity usage event has ended, the controller 550 decreases (block 755) the temperature set point by a fourth decremental amount (e.g., 40° F. or 20° C.) in an attempt to anticipate the quantity of hot water necessary for the next high-quantity usage event. The controller 550 then continues with resetting the flags at block 600.

If, at block 745, the fifth temperature sensor event detection flag is not set, the controller 550 determines if the fifth temperature sensor 575 has detected a high-quantity usage event (block 760). If the fifth temperature sensor 575 has detected a high-quantity usage event, the controller 550 sets the fifth temperature sensor event detection flag (block 765) and continues processing at block 605.

If, at block 760, the fifth temperature sensor 575 has not detected a high-quantity usage event, a high-quantity usage event has not occurred and processing continues at block 605.

For each test of whether the high-quantity usage event has ended (blocks 610, 675, 700, 725, and 750) if the high-quantity usage event has not ended, processing continues at block 605.

In some embodiments, a relation between a sensed temperature following completion of a high-quantity usage event and a desired temperature set point can be determined through experimentation. A controller can detect the sensed temperature following the high-quantity usage event and can set a temperature set point based on the relation (e.g., via a look up table).

In the above embodiments, a temperature set point is adjusted based on the one or more sensed temperatures or rates of change of sensed temperatures following a high-quantity usage event. In some embodiments, the adjusted temperature set point can be used to control the temperature of the water in a water heater immediately following the high-quantity usage event to anticipate the quantity of hot water necessary for the next high-quantity usage event. In some embodiments, the adjusted temperature set point can be used in combination with other control algorithms which can anticipate when a high-quantity usage event may occur. The adjusted temperature set point can be used in anticipation of these events and other temperature set points can be used during periods when high-quantity usage events are not expected.

Thus, the invention provides, among other things, systems and methods for automatically adjusting a temperature set point of a fluid-heating device such that an accurate quantity of fluid is available for high-quantity usage events. Various features and advantages of the invention are set forth in the following claims.

What is claimed is:

1. A fluid-heating apparatus for heating a fluid, the fluid-heating apparatus comprising:
- a vessel;
- an inlet to introduce fluid into the vessel;
- an outlet to remove fluid from the vessel;
- a heating device;
- a temperature sensor; and
- a controller
  - monitoring a temperature of the fluid with the temperature sensor,
  - adjusting the heating device based on the monitored temperature and a temperature set point,
  - determining that a high-quantity usage event has occurred based on the monitored temperature,
  - detecting that the high-quantity usage event has ended, and
  - adjusting the set point following the end of the high-quantity usage event, the adjustment of the set point being based on the monitored temperature when the end of the high-quantity usage event is detected.

2. The fluid-heating apparatus of claim 1 wherein the set point is increased when the monitored temperature is less than a threshold.

3. The fluid-heating apparatus of claim 1 wherein the set point is decreased when the monitored temperature is greater than a threshold.

4. The fluid-heating apparatus of claim 1 wherein the set point is adjusted based on a rate of change of the monitored temperature.

5. The fluid-heating apparatus of claim 1 wherein the set point is not adjusted if the set point is less than a threshold.

6. The fluid-heating apparatus of claim 1 wherein the temperature sensor comprises a plurality of temperature sensors, wherein the set point is adjusted based on which one of the plurality of temperature sensors detects the high-quantity usage event.

7. A method of heating a fluid in a fluid-heating apparatus, the method comprising:
- sensing a temperature having a relation to the fluid;
- determining a high-quantity usage event has occurred if a rate of change of the sensed temperature exceeds a first-rate threshold;
- determining the high-quantity usage event has ended if the rate of change of the sensed temperature is less than a second-rate threshold following the rate of change of the sensed temperature exceeding the first-rate threshold; and
- controlling a temperature set point to effectuate a temperature of the fluid immediately following a subsequent high-quantity usage event that is greater than a low-temperature threshold and less than a high-temperature threshold by
  - increasing the temperature set point if the temperature sensed at the end of the high-quantity usage event is less than the low-temperature threshold, and
  - decreasing the temperature set point if the temperature sensed at the end of the high-quantity usage event is greater than the high-temperature threshold.

8. The method of claim 7 wherein the first-rate threshold is two degrees Fahrenheit per minute for three minutes.

9. The method of claim 7 wherein the second-rate threshold is zero degrees Fahrenheit per minute for three minutes.

10. The method of claim 7 wherein the low-temperature threshold is ninety degrees Fahrenheit.

11. The method of claim 7 wherein the high-temperature threshold is one hundred fifteen degrees Fahrenheit.

12. The method of claim 7 and further comprising activating a heating device when the sensed temperature is less than the temperature set point.

13. The method of claim 7 and further comprising deactivating a heating device when the sensed temperature is greater than the temperature set point.

14. A method of heating a fluid in a fluid-heating apparatus, the fluid-heating apparatus including a temperature sensor for monitoring a temperature of the fluid, the method comprising:
- sensing a first temperature with the temperature sensor;
- controlling a heating device based on the first temperature and a temperature set point;
- determining an occurrence of a high-quantity usage event;
- determining the high-quantity usage event has ended;
- anticipating a quantity of water necessary for a subsequent high quantity usage event by
  - sensing a second temperature with the temperature sensor when the high-quantity usage event is determined to have ended;
  - increasing the temperature set point if the second temperature is less than a low-temperature threshold; and
  - reducing the temperature set point if the second temperature is greater than a high-temperature threshold.

15. The method of claim 14 wherein the temperature sensor is a first temperature sensor coupled to a vessel, wherein the fluid heating apparatus further includes a second temperature sensor coupled to the vessel at a location spatially lower than the first temperature sensor, and wherein the second temperature is sensed by the second temperature sensor.

16. The method of claim 15 and further comprising determining a rate of change of the first temperature and reducing the temperature set point by a factor if the second temperature is between the low-temperature threshold and the high-temperature threshold.

17. The method of claim 16 wherein the factor is a first ratio if the rate of change of the first temperature is less than a rate-of-change threshold.

18. The method of claim 17 wherein the factor is a second ratio if the rate of change of the first temperature is greater than the rate-of-change threshold.

19. The method of claim 14 and further comprising reducing the temperature set point only if the temperature set point is greater than a set point threshold.

20. The method of claim 14 wherein the temperature sensor is a first temperature sensor coupled to a vessel, wherein the fluid heating apparatus further includes a second temperature sensor coupled to the vessel at a location spatially lower than the first temperature sensor and a third temperature sensor coupled to the vessel at a location spatially lower than the second temperature sensor.

21. The method of claim 20 and further comprising raising the temperature set point based on the first temperature and a third temperature sensed by the third temperature sensor if the high-quantity usage event was detected by the first temperature sensor.

22. The method of claim 21 and further comprising lowering the temperature set point a first amount if the second temperature sensor detected the high-quantity usage event and if the high-quantity usage event was not detected by the first temperature sensor.

23. The method of claim 22 and further comprising lowering the temperature set point a second amount if the third temperature sensor detected the high-quantity usage event and if the high-quantity usage event was not detected by the first temperature sensor or the second temperature sensor, the second amount being greater than the first amount.

24. The method of claim 21 wherein the smaller a sum of the first temperature and the third temperature the greater the increase in the temperature set point.

25. The method of claim 20 and further comprising setting the temperature set point to a value relative to the sensed temperature.

* * * * *